United States Patent [19]

Shippee

[11] Patent Number: 4,730,774

[45] Date of Patent: Mar. 15, 1988

[54] DUAL PRESSURE COMPENSATING SNOWMAKING APPARATUS

[76] Inventor: James H. Shippee, P.O. Box 47, Vernon, Vt. 05354

[21] Appl. No.: 2,366

[22] Filed: Jan. 12, 1987

[51] Int. Cl.[4] ..... F25C 3/04

[52] U.S. Cl. ..... 239/14.2; 239/414; 239/61; 239/514; 239/516

[58] Field of Search ..... 239/433, 434.5, 14.2, 239/407, 412, 416.5, 417.3, 408, 514, 516, 517, 408, 409, 410, 414, 417.5, 2.2, 61

[56] References Cited

U.S. PATENT DOCUMENTS 651,900 6/1900 Thurow ..... 239/414
2,643,916 6/1953 White et al. ..... 239/416.5

FOREIGN PATENT DOCUMENTS 17323 7/1903 United Kingdom ..... 239/414

*Primary Examiner*—Andres Kashnikow
*Assistant Examiner*—Chris Trainor
*Attorney, Agent, or Firm*—Sughrue, Mion, Zinn, Macpeak & Seas

[57] ABSTRACT

A snowmaking apparatus is formed of a concentric tubes to define an outer flow passage and an inner circular passage with water carried within the inner flow passage ejected across a pressure compensated annular gap defined by the end of the inner tube and the confronting surface of a spring biased nozzle disk tending to close off that annular gap. The same nozzle disk defines a second annular gap between the nozzle disk and an annular ring fixedly mounted within the outer flow passage has an end face confronting the end face of the nozzle disk. The nozzle disk is preferably mounted on a valve stem and spring biased toward dual gap closing position with the water flow through the inner tube and the compressed air flow through the outer tube acting against the spring bias for dual pressure compensation of the annular gap width, thereby modulating the position of the nozzle disk depending upon the relative pressures of the water and compressed air flows, to maintain the snowmaking capability of the apparatus irrespective of available compressed air and water pressure.

12 Claims, 6 Drawing Figures

DUAL PRESSURE COMPENSATING SNOWMAKING APPARATUS

FIELD OF INVENTION

This invention relates to snowmaking and, more particularly, to a snowmaking apparatus using variable compressed air and water pressure to control nozzle settings for attaining a more uniform water particle size over a wide range of water flow which facilitates improved freezing of all particles useful in snowmaking to reduce energy consumption.

BACKGROUND OF THE INVENTION

The high energy cost in snowmaking is particularly attributed to the compressed air consumption in the air/water type snowmaking nozzles. A number of snowmaking devices involve motor driven fans which use little or no compressed air. The initial cost of this equipment is generally high and must be amortized over a long period even though operational costs are lower than the air/water methods which have low initial investment cost. Many improvements have been made since snowmaking's first applications.

U.S. Pat. No. 4,480,788 to Michael Manhart, issued Nov. 6, 1984, discloses a nozzle in which an adequate air water mixture is proposed by a plurality of bores for initial mixing and a restriction of the same area within. This air and water mixture is then discharged through a second set of orifices.

U.S. Pat. No. 4,465,230 to Robert M. Ash, issued Aug. 4, 1984, is representative of an air and water type nozzle in which water is ejected through a series of orifices and thence through columns of compressed air at the final orifices surrounding the water as it is projected into ambient air.

U.S. Pat. No. 3,923,247 to Jeffery White, issued Dec. 2, 1975, describes a mixing chamber for air and water which is discharged through a defined annular gap including a specially designed converging and diverging horn to accelerate the air water mixture in two stages.

U.S. Pat. No. 3,923,246 to Oscar F. Cloutier, issued Dec. 2, 1975, gives consideration to a spiraling column of air through a single mixing chamber to thoroughly mix the air and water.

U.S. Pat. No. 3,838,815 to Bruce A. Rice, issued Oct. 1, 1974, is constructed with a series of fixed annular opening approximately 0.01 to 0.03 inches across which are fine enough so that water breaks down into fine droplets carried along by the air stream.

U.S. Pat. No. 3,716,190 to James A. Lindlof, issued Feb. 13, 1973, incorporates a Venturi section to first mix air and water and finally a swirl chamber at the final discharge area utilizing an expanding stream of minute air bubbles to atomize the water.

It is, therefore, apparent that much attention has been given to the atomization of the water by mixing it with compressed air. In an overview of the market, it might be noted that snowmaking nozzles with a multitude of small diameter orifices, in general, tend to perform more efficiently at marginally freezing temperatures than those with a larger single orifice. Whereas, at colder temperatures those with smaller multi-orifices often suffer from insufficient water flow as compared to the larger, single orifice nozzles. It may also be said that most air/water snowmaking devices tend to operate most efficiently in a rather narrow range of their total effective capacity.

SUMMARY OF THE INVENTION

The present invention is based in part upon the freezing rate of the water particle size. The area/volume relationship of a spherical water droplet plays an important part in snowmaking efficiency. Larger droplets have a greater volume per net area than do smaller droplets and require more time to freeze. In most systems water particle size is controlled in operation by the volume of water supplied to the apparatus in relationship to the volume of compressed air consumed. To assure adequate freezing at warmer temperatures, small water particles are generated using less water volume and more air volume. Larger particles will adequately freeze at colder temperatures with less consumed compressed air. The physical design of a snowmaking nozzle can also alter the water droplet size. Often interchangeable nozzles are used to accomplish this. Even so, increased water flow through a fixed orifice following an exponential equation is quickly limited by the system pressure available.

One object of the present invention is to incorporate a pressure compensating variable annular orifice to attain higher than fixed orifice flow rates with increased pressure.

By using a spring and pressure compensating annular gap, water particle size can be controlled as well as the water pressures and flow rates.

Another object is to use air pressure to also affect the annular gap size such that with system air pressure changes, water flow compensation will provide a more constant air to water ratio.

Another object of the present invention is to provide an improved relationship between the water and compressed air. Water flow is held to a more uniform velocity rather than allowed to accelerate freely in the presence of the compressed air. This results increased relative velocities within the apparatus for added evaporational cooling. As part of the adjustable annulus, a group of one or more nozzle disk sections may be incorporated to vary the pattern of the projected water particles. In applications where orifices are included through such nozzle assembly, a cyclonic mixing may be generated within the mainstream of water and air. From an efficiency standpoint it is important that a thorough mixing of smaller water particles which are generally first to bear condensating nuclei come into contact with larger water particles to maximize freezing of all water particles.

DESCRIPTION OF THE PREFERRED EMBODIMENTS

Figure 1:
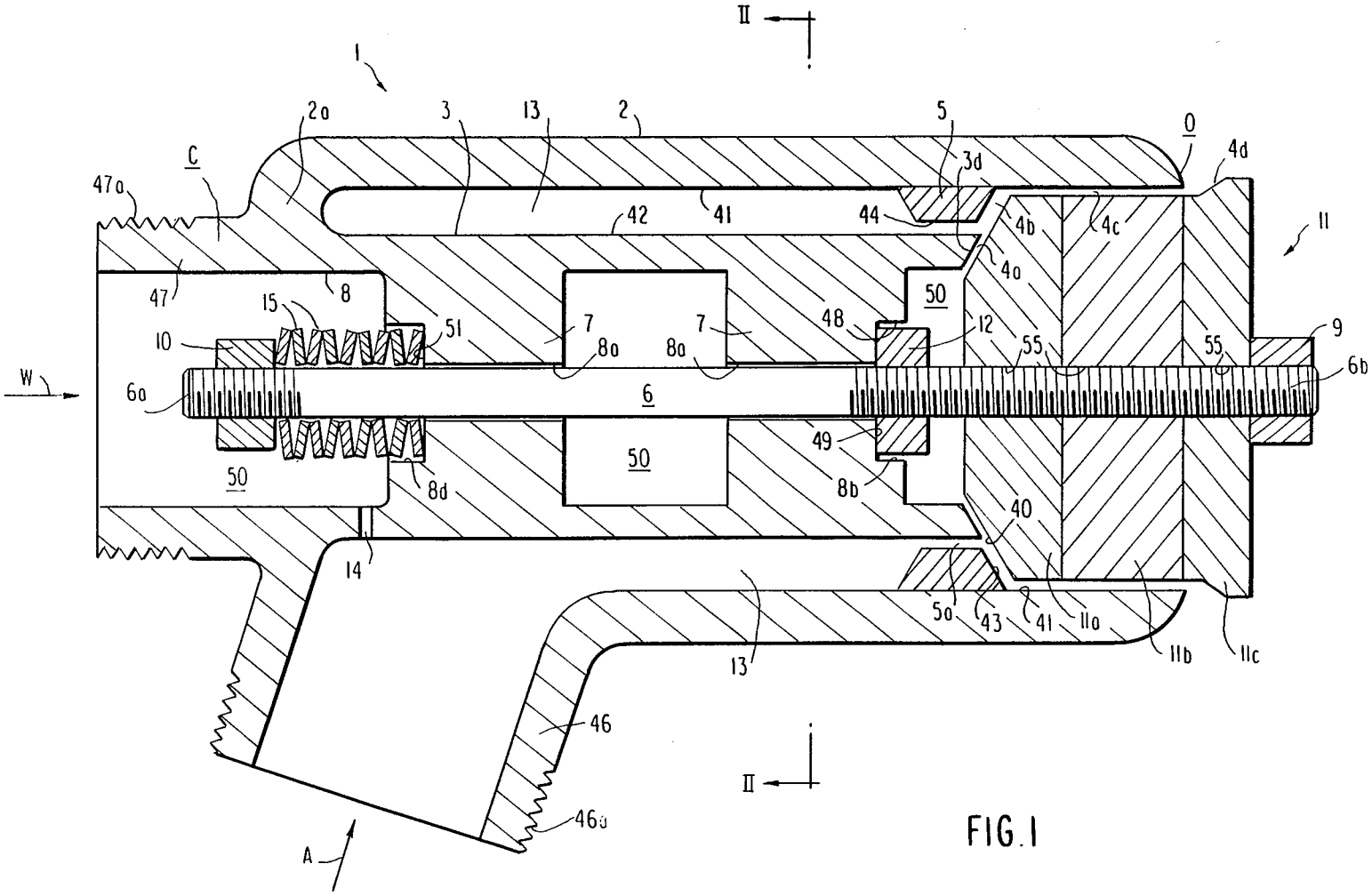
FIG. 1 is a longitudinal sectional view of a snowmaking apparatus forming a preferred embodiment of the present invention.
Figure 2:
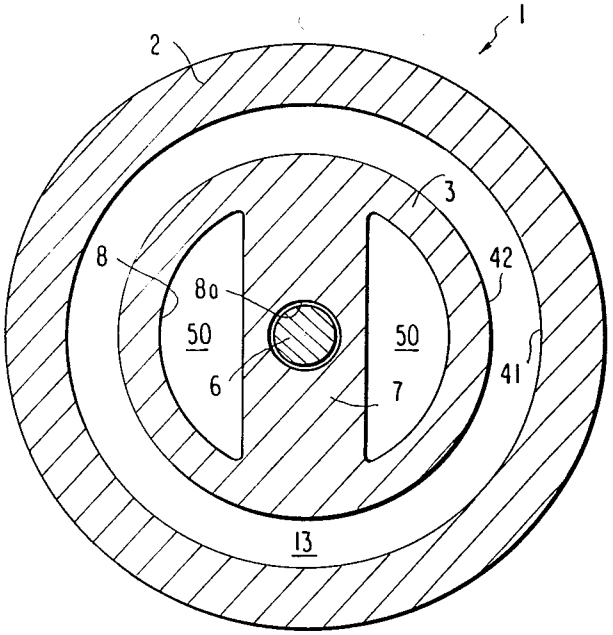
FIG. 2 is a cross sectional view of the apparatus of FIG. 1 taken about line II—II.

In the various embodiments, like elements are given like numerical designations. Referring first to FIGS. 1 and 2, the snowmaking apparatus or snow gun forming one embodiment of the invention is illustrated generally at 1 and is composed mainly of an outer housing 2 which is open to the atmosphere at one end O and closed at the opposite end C by an inner and concentric cylindrical tube 3. End wall 2*a* of the outer housing 2 joins the inner and outer concentric cylindrical tubes 2*a*, 3 and forms an annular chamber 13 therebetween. The inner, concentric cylindrical tube 3 is provided with an axial bore 8 which forms a water supply chamber 50 which is open at the rear. The inner, concentric cylindrical tube 3 terminates in an outwardly diverging, oblique end face 3*d* to form a annular, oblique orifice 4*a* between that end face 3*d* and a similarly angled conical surface 40 of a first nozzle disk 11*a* of circular form. The nozzle disk 11*a* is one element of a three-part nozzle assembly indicated generally at 11 and consisting of an intermediate cylindrical nozzle disk 11*b* and an exterior nozzle disk 11*c*. The disks 11*a*, 11*b* and 11*c* have tapped axial holes and are threaded to the end 6*b* of valve stem 6. The outer concentric cylindrical tube 2*a*, has a inner diameter 41 which is slightly larger than the diameter of the nozzle disks 11*a*, 11*b* of nozzle assembly 11 to form an annular gap or orifice 4*c* therebetween. The outer diameter 42 of the inner, concentric cylindrical tube 3 is significantly smaller than the inner diameter 41 of the outer concentric cylindrical tube 2*a* to form chamber 13 therebetween. Fixedly mounted to the outer concentric cylindrical tube 2*a* on its inner surface 41 is an annular ring 5 which has a radial thickness which is less than the radial width of chamber or cavity 13, within which it is positioned. The ring 5 is provided with an oblique end face 43 facing the conical surface 40 of nozzle disk 11*a* and ring 5 has an inner peripheral surface 44 which faces but is spaced from the outer periphery or surface 42 of the inner concentric cylindrical tube 3 thereby forming an annular gap or orifice 5*a* therebetween. Tube end face 3*d*, conical face 40 of the nozzle disk 11*a* and end face 43 of the annular ring 5 are preferably parallel. Thus, a first annular gap or orifice 4*a* is formed between end face 3*d* of the inner, concentric cylindrical tube 3 and nozzle disk 11*a*, a second annular gap or orifice 4*b* is formed between oblique end face 43 of annular ring 5 and the same confronting conical surface 40 of the nozzle disk 11*a*, a third annular gap or nozzle orifice 4*c* is formed between the inner periphery 41 of the outer concentric cylindrical tube 2*a* and the peripheries 45 of the coaxial nozzle disks 11*a*, 11*b*. Additionally, a fourth annular gap or nozzle orifice, orifice 5*a* is formed between the inner periphery 44 of the annular ring 5 and the outer periphery 42 of the inner concentric cylindrical tube 3.

The outer housing 2 which is preferably made of a lightweight cast metal such as aluminum is integrally provided with cylindrical fitting 46 whose outer periphery is threaded at 36*a* for coupling to a compressed air the supply hose (not shown)) for supply of compressed air, indicated schematically by the arrow A, to annular chamber 13 which is open to the interior of fitting 46. Further, the outer housing 2 terminates at its closed end C in a cylindrical fitting 47 which is provided with exterior threads at 47*a* on its outer periphery permitting suitable coupling to a water supply hose (not shown) which supplies water under considerable pressure, as indicated schematically by the arrow W, to chamber 15 defined by fitting 47 and bore 8 of inner tube 3. The inner concentric cylindrical tube 3 is formed with a pair of longitudinally spaced chamber bisecting valve guides 7 having aligned axial bores 8*a* which slidably support a valve steam or rod 6. The valve steam 6 is threaded at one end 6*b* and carries a lock nut 9 which locks the threaded nozzle disks 11*a*, 11*b*, 11*c* of nozzle assembly 11 on the threaded end 6*b* of the valve steam or rod 6. The nozzle disks 11*a*, 11*b*, and 11*c* form a movable valve nozzle for the assembly tending to close off the annular gaps or orifices 4*a*, 4*b* previously described. An annular locking collar 12 is threadably coupled to the valve stem 6*b* and is received by an annular recess 48 defined by counterbore 8*b* within the downstream valve guide 7. collar 12 may be pinned to stem 6. The locking collar 12 may be adjusted axially along valve stem 6 to define the width of the annular gap or orifice 4*a* between end face 3*a* of the inner concentric tube 3 and the conical surface 40 of nozzle disk 11*a*. The locking collar is maintained in abutment with shoulder 49 of the inner concentric cylindrical tube 3 formed by counterbore 8*b*, that contact being effected by the series of disk springs 15 which are concentrically interposed on the valve stem 6 at upstream threaded end 6*a* and between an axially adjustable adjustment nut 10 and a radial shoulder 51 defined by counterbore 8*d* at that end of the housing 2. The series of disk springs 15 may be replaced by a compression coil spring which performs the same function of biasing the nozzle assembly 11 towards a near valve closed position limited to a narrow annular gap or orifice 4*a* between the upstream nozzle disk 11*a* and the oblique annular end face 3*a* of the inner concentric cylindrical tube 3. The valve stem 6 slidably mounts within axial bore sections 8*a* of valve guides 7. Water W flows through the chamber 50 to impinge agains disk 11*a* and then through the annular nozzle orifice defined by orifice 4*a*. The oblique water flow continues through the second annular gap or orifice 4*b* between conical surface 40 of disk 11*a* and the oblique end face 43 of annular ring 5 with the water W impinging against the inner periphery of the surface 41 of the outer tube 2*a*, downstream of the annular ring 5 where it deflects nearly 90° so to flow parallel to the axis of the gun 1 through the annular gap 4*c*. Simultaneously, compressed air A passes through the relatively large annular chamber 13 and the relatively small annular gap 5*a* between the inner periphery 44 of annular ring 5 and the outer periphery 42 of the inner concentric cylindrical tube 3 intersecting the water flow. The compressed air flowing across the surface of the water flow exiting through the annular gap 4*a* to creates a first phase mixing between the relative velocity flow of the compressed air and water at this point. Due to the interaction of the air and water flow across the annular gap 4*c*, the mixture of air and minute water particles within annular gap 4*c* is ejected forwardly of the gun 1. This flow is diverted in the embodiment of FIG. 1 by a diverging conical surface portion 4*d* of valve element 11*c* whose outer diameter is in excess of the inner diameter 41 of outer tube 2*a*. Operation may be effected without the nozzle valve section 11*c*, the effect of which is to cause the flow of expanding air carrying the minute water particles to be projected axially rather than radially of the gun 1. Thus, a more forwardly projected air and water mainstream occurs. The elimination of both nozzle sections 11*b* and 11*c* will result in a very narrow mainstream and the most forward projection of the air carried water particles.

A self-compensating action occurs using the invention since the water pressure in chamber 50 acting against the nozzle valve disk 11*a* compresses the spring or springs 15 thereby increasing the width of annular gaps 4*a*, 4*b*. Additionally, the air under pressure exiting from chamber 13 through annular gap 5*a* also impinges upon conical surface 40 of valve element 11*a* to effect both compression of springs 15 and nozzle disk valve movement. The position of the concentric annular ring 5 is important. It may be located at a sufficient distance from the conical surface 40 of the valve disk 11*a* so changes in the gap 4*b* have little effect on the total of passageway area, hence little effect on the compressed air flow. On the other hand, by positioning the annular ring 5 closer to nozzle disk 11*a* reducing the width of the annular gap 4*b* will have a noticeable effect on air flow, the result being a tentative increase in air flow with increased water pressure. The water flow likewise reduces the compressed air flow at lower water pressures since the drop in water pressure tends to narrow the gap 4*a* and simultaneously the gap 4*b* through which both the air and water passes.

Preferably a small diameter hole 14 is drilled through the inner concentric cylindrical tube 3 from chamber 13 to chamber 50 to assure water drainage in applications where the gap 4*a* completely closes upon removal of water and air pressure applied to chambers 13 and 50, respectively. Of course, such drain of water may also be accomplished with a very small initial minimum gap at gap 4*a*.

As seen in FIG. 2, the chamber 50 runs the full length of the inner concentric cylindrical tube 3 with the vertical, longitudinally spaced valve guides or ribs extending across the chamber 50 from top and bottom and with chamber 50 terminating at its forward end by being blocked off by the upstream or first nozzle disk 11*a*. However, water W under pressure can escape from chamber 50 solely through the annular gap 4*a* between the conical end face 3*a* of the inner tube 3 and the conical surface 40 of the upstream or first valve disk 11*a*.

Figure 3:
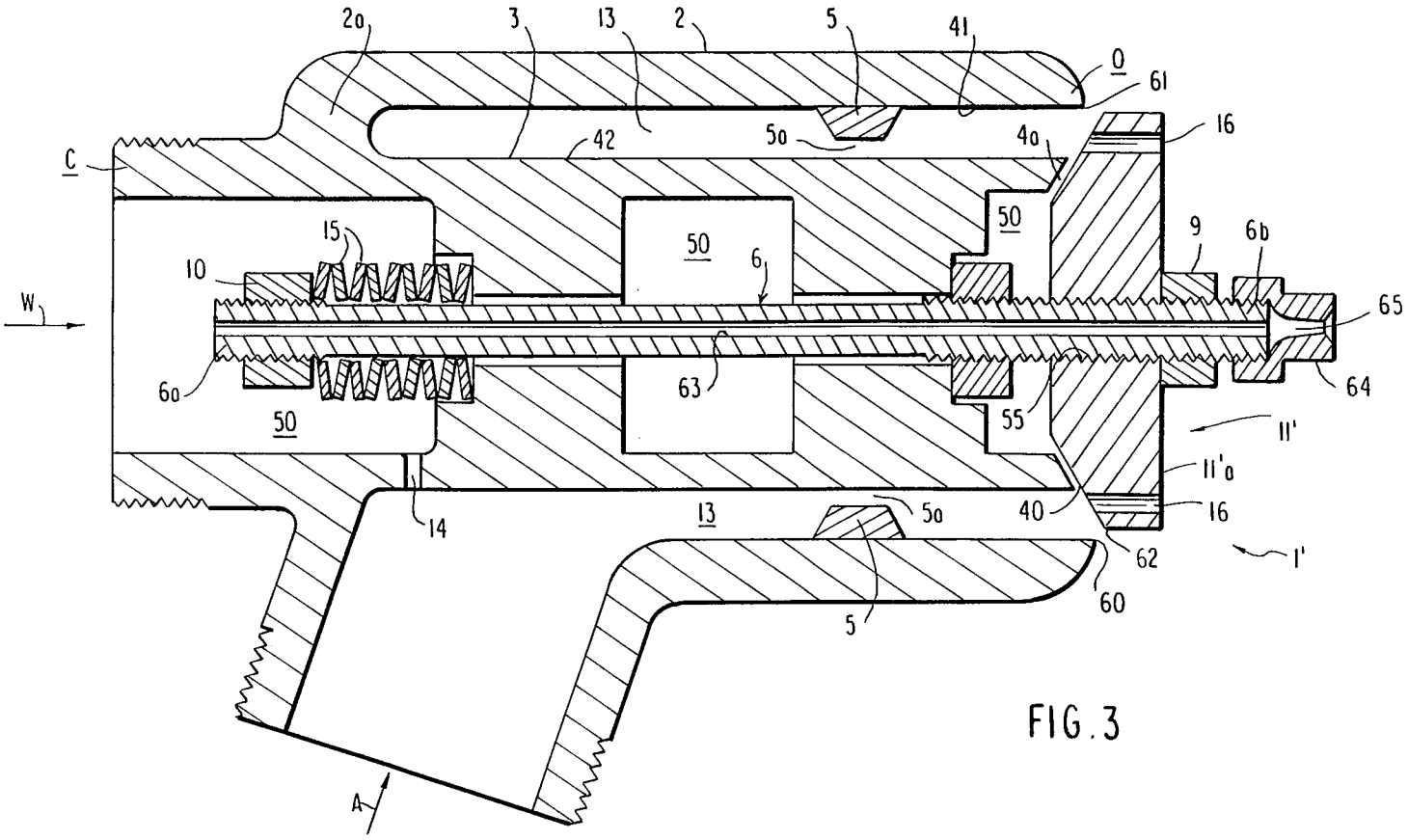
FIG. 3 is a longitudinal sectional view of a snowmaking apparatus forming a second embodiment of the invention.

Referring next to FIG. 3, a second embodiment of the valve of the snowmaking gun or apparatus 1' takes essentially the same form utilizing basically the same components with certain modifications. The outer concentric cylindrical tube 2*a*, is somewhat shorter in length than in the prior embodiment and its forward end does not overlie the valve disk 11'. Further, the assembly 11' consists of a single modified nozzle disk 11'*a* which includes a plurality of drilled holes as at 16 within the nozzle disk near its outer periphery and aligned with chamber 13. The holes are oblique to the axis of the gun and that of the disk 11*a* to effect swirl flow to air passing therethrough. Further, the end O of outer housing tube 2*c* terminates just rearwardly of the outer edge of the conical surface 40 of nozzle disk 11'*a* to define a somewhat narrow gap 60 between edge 61 of the outer concentric cylindrical tube 2*a* and edge 62 of the nozzle disk 11'*a*. Further, the annular ring 5 is positioned quite remote from the conical surface 40 of the nozzle disk 11'*a*. Preferably, the valve stem 6 is hollow, being provided with an axial bore 63 which runs the full length of the same. In addition, a Venturi nozzle indicated generally at 64 is threadably coupled to the threaded end 6*b* of valve stem 6 having a nozzle passage 65 coaxial with bore 63 within the valve stem. In all other respects the snowmaking apparatus or gun 1' is similar in operation to that of the first embodiment.

In operation, the water W under pressure passes through the chamber 50 impinging against the nozzle disk 11'*a* and tending by way of its pressure to compress springs 15 and increase the width of the annular gap 4*a*, allowing the water W to discharge under pressure in a oblique path which is more radial than axial. Further, the water jetting from chamber 50 through the annular gap or orifice 4*a* does not impinge on the inner periphery 41 of the outer tube 2*a* in this embodiment. The air in expanding after passage through the annular gap 5*a* between the annular ring 5 and the outer periphery 42 of the inner concentric cylindrical tube 3 impinges against the stream of water exiting from the gap 4*a* where the water mixes as fine particles in the expanding air stream. Additional water flows through bore 63 of the hollow valve stem 6 and through the Venturi passage 63 of nozzle member 64 to provide a central core of water flow without compressed air which may be added to the mainstream consisting of compressed air bearing fine water particles. Again, both the compressed air and the water under pressure contribute to the compression of the springs 15 and the self-adjustment of the annular gap 4*a* as well as the annular gap 60 for the compressed air plus water particles respectively prior to the mainstream exiting between the valve disk 11'*a* and the tip 61 of the outer concentric tube 2*a*.

Figure 4B:
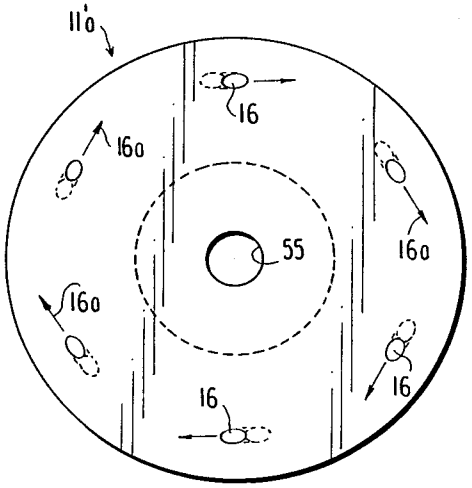
FIGS. 4*a* and 4*b* are side and front views, respectively, of a nozzle valve disk employed in the apparatus of FIG. 3.
Figure 4A:
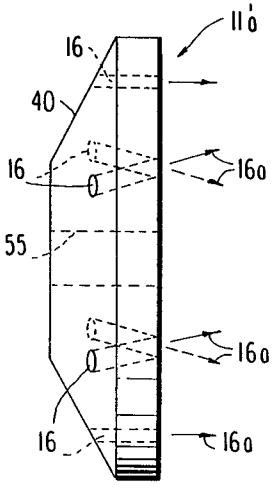

In the various embodiments, different types of first nozzle disks may be employed. In FIGS. 4*a*, 4*b*, the first nozzle disk 11'*a* of FIG. 3 is separately illustrated to show the action of the series of angled bores or holes 16 which are not parallel to the axis of the disk and the central bore 55 through which the valve stem 6 passes but which are angled obliquely, in the circumferential direction. The angulation is identical for all bores and in the same direction so as to set up a swirling action to the flow of compressed air and water particles which pass therethrough thereby inducing a cyclonic motion within the mainstream of the compressed air and water particle mixture which further induces vortices around the exterior of the mainstream to facilitate the making of snow under a wide range of ambient temperatures and at various air and water pressures. The direction of movement of the various flow emanating from the oblique orifices 16 may be best seen by the arrows 16*a* in FIG. 4*b* corresponding to the same numbered arrows in FIG. 4*a*.

Figure 5:
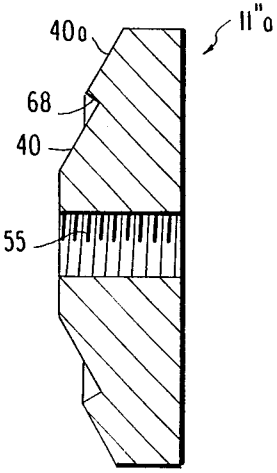
FIG. 5 is a sectional view of a further nozzle valve disk for use in the apparatus of FIGS. 1 and 3.

FIG. 5 shows a first nozzle disk 11''*a* which may be substituted for the first nozzle disk 11*a* of FIG. 1 or the first nozzle disk 11'*a* of FIG. 3. Nozzle disk 11'*a* incorporates a conical surface projection 40*a* at the radially outboard end of the conical surface 40 creating a right angle step or radial wall 68 against which the water flow impinges in exiting the gap 4*a*. For instance in the embodiment of FIG. 3 with disk 11''*a* substituted for disk 11'*a* of the water flow is sheared by the compressed air impinging against the conical surface 40*a* of valve disk 11''*a*. Further the water flow W itself impinges against the right angle wall 68, thereby breaking up the water W into fine particles to cause a more effective mixture between the water and air prior to leaving through the small gap 60 as a fine water spray enhancing formation of snow particles and improving the efficiency of the snowmaking gun 1'.

While the invention has been shown and described in detail with reference to a preferred embodiment thereof, it will be understood to those skills in the art to which this invention pertains that various changes in form and detail may be made therein without departing from the spirit and scope of the invention.

What is claim is:

1. A dual pressure compensating snowmaking apparatus comprising an outer housing including concentric, radially spaced inner and outer tubes defining a first annular flow passage between said tubes and a second cylindrical flow passage within said inner tube, first nozzle means secured by said housing for tending to close off said second flow passage at said open end of said inner tube and defining a first nozzle gap between said first nozzle means and the open end of said inner tube, second means nozzle means carried by said housing for tending to close off said first flow passage at the open end of said outer tube and defining a second nozzle gap, means for supplying compressed air to said first flow passage, means for supplying water under pressure to said second flow passage such that; water under pressure passes through said first gap towards second gap, and compressed air impinges the flow of water exiting from said first nozzle gap, mixes with said water and entrains the water as minute water particles and flows through said second nozzle gap, and means for commonly, continuously self-adjusting said first and second nozzle means to vary said first and second nozzle gaps in response to vary in pressure of the compressed air and water to automatically increase air flow with increase in water pressure and water flow and a reduction in compressed air flow at lower water pressure to maintain the snowmaking capability of the apparatus irrespective of ambient temperature variation and variation in pressure of the compressed air and water supplied therein.

2. The apparatus as claimed in claim 1 wherein said first and second nozzle means comprise a unitary nozzle member overlying the open ends of said first and second tubes, means for mounting said unitary nozzle member for movement towards and away from the ends of said first and second tubes and resilient means operatively coupled to said unitary nozzle member tends to bias said unitary nozzle member in a direction tending to close said first and second nozzle gaps and constituting said self-adjusting means.

3. The apparatus as claimed in claim 2 wherein said unitary nozzle member comprises a circular nozzle disk.

4. The apparatus as claimed in claim 3 wherein, at least one guide valve member is mounted within said inner tube, an axial bore extends within said at least one valve guide, a valve stem is slidably mounted within said valve guide bore, said at least one nozzle disk is fixedly mounted to one end of said valve stem for movement towards and away from the open ends of said first and second inner and outer tubes for closing off said first and second flow passages defined thereby, and said resilient means comprises spring means operatively positioned between said housing and said valve stem for biasing said at least one nozzle disk in a direction tending to close off said flow passages.

5. The apparatus as claimed in claim 4 wherein said inner tube terminates at its open end in outwardly diverging oblique end face and said disk includes a conical surface facing the end face of said inner tube and being parallel to that end face such that the end face of said inner tube and the conical surface of said disk defines said first nozzle gap.

6. The apparatus as claimed in claim 5 wherein, said outer tube carries an annular ring fixedly mounted to the inner periphery thereof having a radial thickness less than that of the radial width of the first flow passage defined by said inner and outer tube and wherein said annular ring includes an end oblique face and said ring is fixedly positioned on said outer tube such that the oblique end face is coplanar with the end face of the inner tube, and wherein, said conical surface of said at least one nozzle disk overlies the oblique end face of said annular ring such that such annular ring oblique end face and said nozzle disk conical surface defines said second nozzle gap.

7. The apparatus as claimed in claim 6 wherein, said outer tube extends axially beyond the end of said inner tube at the open end of said housing and wherein, said at least one nozzle disk has a diameter slightly smaller than the inside diameter of said tube such that the periphery of the nozzle disk is spaced from the outer tube and forms with the outer tube a third nozzle gap downstream of said second nozzle gap defined by the conical surface of said nozzle disk and the oblique end face of said annular ring.

8. The apparatus as claimed in claim 7 wherein said at least one nozzle disk extends axially beyond the open end of said outer tube and includes a radially enlarged portion forming a diverging oblique surface in the path of the compressed air and entrained water particles passing through said third annular nozzle gap thereby deflecting the flow mainstream formed thereby away from the axis of said apparatus thereof.

9. The apparatus as claimed in claim 4 wherein said valve stem in threaded on opposite ends, said at least one nozzle disk has an axial bore and sized to the valve stem and being slidably mounted thereon, a lock nut is threaded to the end of the valve stem bearing said at least nozzle disk, a collar is fixedly mounted to the side of said nozzle disk opposite that of said lock nut and limiting axial movement of said at least one nozzle disk in a direction tending to close off said first gap, said resiliently means biasing said nozzle disk toward gap closed position comprises spring means mounted concentrically about the end of said valve disk remote from said nozzle disk to the side of said valve guide remote from said at least one nozzle disk and an adjustment nut threadably mounted to the end of the valve stem beyond said concentric spring means so as to compress the spring means longitudinally between the adjustment nut and the valve guide bearing said valve stem.

10. The apparatus as claimed in claim 3. wherein said at least one nozzle disk comprises a plurality of circumferentially spaced holes passing through said disk, parallel to the nozzle disk axes, aligned with the first flow passage, said holes being angularly oblique circumferentially, at a common angle and in the same direction such that the compressed air and entrained water particles passing therethrough form a cyclonic flow within the mainstream of the flow entering the apparatus at second gap and which in turn, produces vortices around the exterior of the mainstream, maximizing the creation of water particles and the intimate mixing of the water particles with expanding compressed air.

11. The apparatus as claimed in claim 4 wherein, said valve stem is hollow and wherein, a tubular nozzle is mounted to the valve stem, axially downstream of said at least one nozzle disk to supply an axial stream of water into the center of the compressed and entrained water mainstream exiting the apparatus through said second nozzle gap.

12. The apparatus as claimed in claim 4 wherein, said conical surface of said at least one nozzle disk facing said first flow passage includes a step to cause the water flow exiting from said first gap to impinge the step within the conical surface such that compressed air flow tends to shear the water flow exiting from the first nozzle gap in the area of water impingement with said step, thereby increasing the formation of water particles and the mixing of the same within the compressed air as it flows across said second gap prior to exiting from said apparatus to the atmosphere.

* * * * *

UNITED STATES PATENT AND TRADEMARK OFFICE

CERTIFICATE OF CORRECTION

PATENT NO. : 4,730,774

DATED : March 15, 1988

INVENTOR(S) : SHIPPEE

It is certified that error appears in the above-identified patent and that said Letters Patent is hereby corrected as shown below:

| | |
|---|---|
| COLUMN 7, LINE 11 | Delete the second instance of "said" and insert --an-- |
| COLUMN 7, LINE 15 | Delete "the" at the end of the line and insert --an-- |
| COLUMN 7, LINE 20 | After "towards" and before "second" insert --said-- |
| COLUMN 7, LINE 27 | Delete "vary" and insert --variance-- |
| COLUMN 7, LINE 37 | Delete "first and second" and insert --inner and outer-- |
| COLUMN 7, LINE 40 | Delete "first and second" and insert --inner and outer-- |
| COLUMN 7, LINE 51 | Delete "said" and insert --and-- |
| COLUMN 8, LINE 3 | Delete "tube" and insert --tubes-- |
| COLUMN 8, LINE 4 | Delete "end oblique" and insert --oblique end-- |
| COLUMN 8, LINE 16 | After "said" and before "tube" insert --outer-- |

UNITED STATES PATENT AND TRADEMARK OFFICE

CERTIFICATE OF CORRECTION

PATENT NO. : 4,730,774

DATED : March 15, 1988

INVENTOR(S) : SHIPPEE

It is certified that error appears in the above-identified patent and that said Letters Patent is hereby corrected as shown below:

COLUMN 8, LINE 29 Delete "flow mainstream" and insert --mainstream flow--

Signed and Sealed this

Thirteenth Day of September, 1988

*Attest:*

DONALD J. QUIGG

*Attesting Officer*

*Commissioner of Patents and Trademarks*